US008459329B2

(12) United States Patent
Connerley

(10) Patent No.: US 8,459,329 B2
(45) Date of Patent: Jun. 11, 2013

(54) FLEXIBLE PARTITION ROLLER SYSTEM

(75) Inventor: James J. Connerley, Noblesville, IN (US)

(73) Assignee: Gared Holdings, LLC, Noblesville, IN (US)

( * ) Notice: Subject to any disclaimer, the term of this patent is extended or adjusted under 35 U.S.C. 154(b) by 259 days.

(21) Appl. No.: 13/098,561

(22) Filed: May 2, 2011

(65) Prior Publication Data

US 2012/0279668 A1 Nov. 8, 2012

(51) Int. Cl.

| | |
|---|---|
| ***E06B 9/08*** | (2006.01) |
| ***A47H 1/00*** | (2006.01) |
| ***A47G 5/02*** | (2006.01) |
| ***B65H 75/38*** | (2006.01) |
| ***B65H 75/48*** | (2006.01) |

(52) U.S. Cl.
USPC ..... 160/243; 242/388.1; 242/390.8; 160/120; 160/310

(58) Field of Classification Search
USPC ..... 160/120, 121.1, 122, 24, 243, 245, 160/242, 246, 249, 301, 311; 242/378.1, 242/388.1, 390.8, 390.9, 907; 310/90, 67 R
See application file for complete search history.

(56) References Cited

U.S. PATENT DOCUMENTS

| | | | | |
|---|---|---|---|---|
| 3,181,816 | A * | 5/1965 | Pfleiderer | 244/17.17 |
| 3,900,063 | A | 8/1975 | Roller | 160/310 |
| 5,429,171 | A | 7/1995 | Hamilton | 160/243 |
| 5,524,693 | A | 6/1996 | Hamilton | 160/243 |
| 5,533,214 | A | 7/1996 | Graham | 4/502 |
| 5,819,835 | A | 10/1998 | Broome | 160/243 |
| 5,890,240 | A | 4/1999 | Graham | 4/502 |
| 6,032,717 | A | 3/2000 | Belgoff | 160/309 |
| 6,131,641 | A * | 10/2000 | Schroeder | 160/242 |
| 6,401,794 | B1 | 6/2002 | Hamilton | 160/243 |
| 7,028,742 | B2 * | 4/2006 | Sears et al. | 160/310 |

FOREIGN PATENT DOCUMENTS

| | | |
|---|---|---|
| CA | 2 104 416 C | 11/1994 |
| CA | 2 150 771 C | 11/1996 |
| CA | 2 348 816 A1 | 11/2002 |

* cited by examiner

*Primary Examiner* — Katherine Mitchell
*Assistant Examiner* — Jeremy Ramsey
(74) *Attorney, Agent, or Firm* — Brinks Hofer Gilson & Lione

(57) ABSTRACT

A system positioning a flexible partition at a desired vertical position includes an elongated cylinder extending across the entire partition, connected to the partition to divide the partition into upper and lower portions. An outer bearing is fixed to an outside surface of a first end of the elongated cylinder. A proximal end of an arm is coupled to the outer bearing outer surface, the outer bearing permitting rotation of the elongated cylinder with respect to the arm. A counterweight is fixed to a distal end of the arm, to inhibit movement of the arm during any rotation of the elongated cylinder. A rotor portion of a motor is coupled to the elongated cylinder for rotating the cylinder, and a bracket is fixed to stator portion of the motor and to the arm proximal end to inhibit rotation of the stator during any rotation of the elongated cylinder.

17 Claims, 6 Drawing Sheets

FLEXIBLE PARTITION ROLLER SYSTEM

BACKGROUND

The present invention is directed to a flexible partition or curtain with an integrated roller wind-up apparatus. In particular, the present invention relates to a torque-balanced motorized roller system for controlling the vertical position of a flexible partition or curtain.

It is known to utilize flexible sheet type curtains, which are adapted to be rolled up and down, to divide or partition a large room such as a gymnasium. In most cases, an electric motor drives a shaft on which the curtain is hung. U.S. Pat. No. 3,900,063 discloses a motor and primary roller device mounted adjacent to the trusses or rafters supporting a ceiling. An upper end of the curtain is attached to the primary roller and the lower end can be varied in vertical position by rolling and un-rolling the primary roller. The weight of the curtain is supported in part on secondary rollers that are positioned below the primary roller, which is vertically movable based on the amount of curtain material wound on to the primary roller.

U.S. Pat. No. 5,524,693 discloses a flexible partition or curtain for dividing a room that has a top edge suspended from a ceiling, and a bottom edge touching the floor when the curtain is fully deployed. An elongated cylinder is connected to the curtain to extend from one side edge to the other to divide the curtain into upper and lower portions. A motor is located at one end of the cylinder and connected to rotate the cylinder so that the upper and lower portions of the curtain will be wound up on the cylinder when it is required to roll up the curtain. A torque reacting mechanism, in the form of an arm fixed to the motor exterior of the cylinder and at a right angle to the axis of the cylinder, includes a second winding element mounted on the arm with a flexible sheet suspended from the ceiling parallel to the upper portion of the curtain. The flexible sheet is winds onto the second winding element in a counter-rotational direction so as to counteract the torque of the motor.

Assuming the same rotational speed for the cylinders in both these prior patents, the roller of U.S. Pat. No. 5,524,693 should lift the lower edge of the curtain faster than the roller disclosed in U.S. Pat. No. 3,900,063. However, the load placed on the flexible sheet on the second winding element requires that the flexible sheet itself be subject to minimum or negligible stretching characteristics. Additionally, while the curtain of U.S. Pat. No. 5,524,693 should lift faster, during descent the flexible sheet on the second winding element may not provide the correct rotational reaction to the curtain unwinding if the descent is too fast. Consequently, the lowering speed may be required to be less than the raising speed. Additionally, if the lowering speed is too great, the arm holding the second winding element could rise and even flip over rendering the torque balance effect useless.

There remains a need for even better systems for raising and lowering a flexible partition or curtain using an integrated roller wind-up apparatus.

SUMMARY

One such system can have an elongated cylinder extending from one side edge of the flexible partition to an opposite side edge, the cylinder being connected to the partition and dividing the partition into upper and lower portions. An outer bearing can be fixed to an outside surface of a first end of the elongated cylinder. An outside surface of the outer bearing can have a protrusion extending radially with respect to the elongated cylinder. A proximal end of an arm can be coupled to the outer bearing outer surface so that the outer bearing permits rotation of the elongated cylinder with respect to the arm. The outer bearing outer surface protrusion can act to inhibit any axial motion of the arm relative to the elongated cylinder. A counterweight can be fixed to a distal end of the arm to inhibit movement of the arm during any rotation of the elongated cylinder. A first portion of a motor having a rotor portion and a stator portion can be coupled to the elongated cylinder for rotating the cylinder. A bracket can be fixed to a second portion of the motor and to the arm proximal end so that the bracket extends over the protrusion of the outer bearing to couple to the arm to inhibit rotation of the second portion of the motor during any rotation of the elongated cylinder.

In one embodiment the first portion of the motor can be the rotor portion while the second portion of the motor can be the stator portion. At least one inner bearing can be located between the stator portion of the motor and the elongated cylinder to permit rotation of the elongated cylinder relative to the stator portion of the motor. The proximal end of the arm can include a ring surrounding the outer bearing. The ring can have an inner diameter less than the outer diameter of the outer bearing protrusion so that the protrusion provides a stop preventing axial movement of the proximal end of the arm relative to the elongated cylinder. A drive adapter can be coupled between the rotor portion of the motor and an inside surface of the elongated cylinder. The drive adapter can have an outside surface that includes depressions engaging inward protrusions on the inner surface of the elongated cylinder. The inward protrusions on the inner surface of the elongated cylinder can correspond to longitudinal grooves on the outer surface of the elongated cylinder. The longitudinal grooves can be located diametrically opposite each other, and each groove can receive a terminal edge of one of the upper and lower portions of the partition or curtain.

In a preferred embodiment the elongated cylinder can have a mass $M_C$ and a radius $R_C$. The lower portion of the partition can have a mass $M_L$. The motor can have a mass $M_M$. The counterweight can have a mass $M_W$ fixed to the arm at a distance $R_A$ from the proximal end. The counterweight mass $M_W$ and the length of the arm $R_A$ can be selected to provide a torque $M_W \times R_A > (M_L + M_C + M_M) \times R_C$ to inhibit rotation of the arm during any rotation of the cylinder.

One feature of the present roller system is that the torque balance arm provides the necessary balancing without any external connection. This feature has the advantage of achieving a more reliable balancing function with fewer parts and less chance for failure. Other features of the present roller system and the corresponding advantages of those features will be come apparent from the following discussion of a preferred embodiment of the present invention, exemplifying the best mode of practicing the present invention, which is illustrated in the accompanying drawings. The components in the figures are not necessarily to scale, emphasis instead being placed upon illustrating the principles of the invention. Moreover, in the figures, like referenced numerals designate corresponding parts throughout the different views.

DESCRIPTION OF PREFERRED EMBODIMENTS

Figure 1:
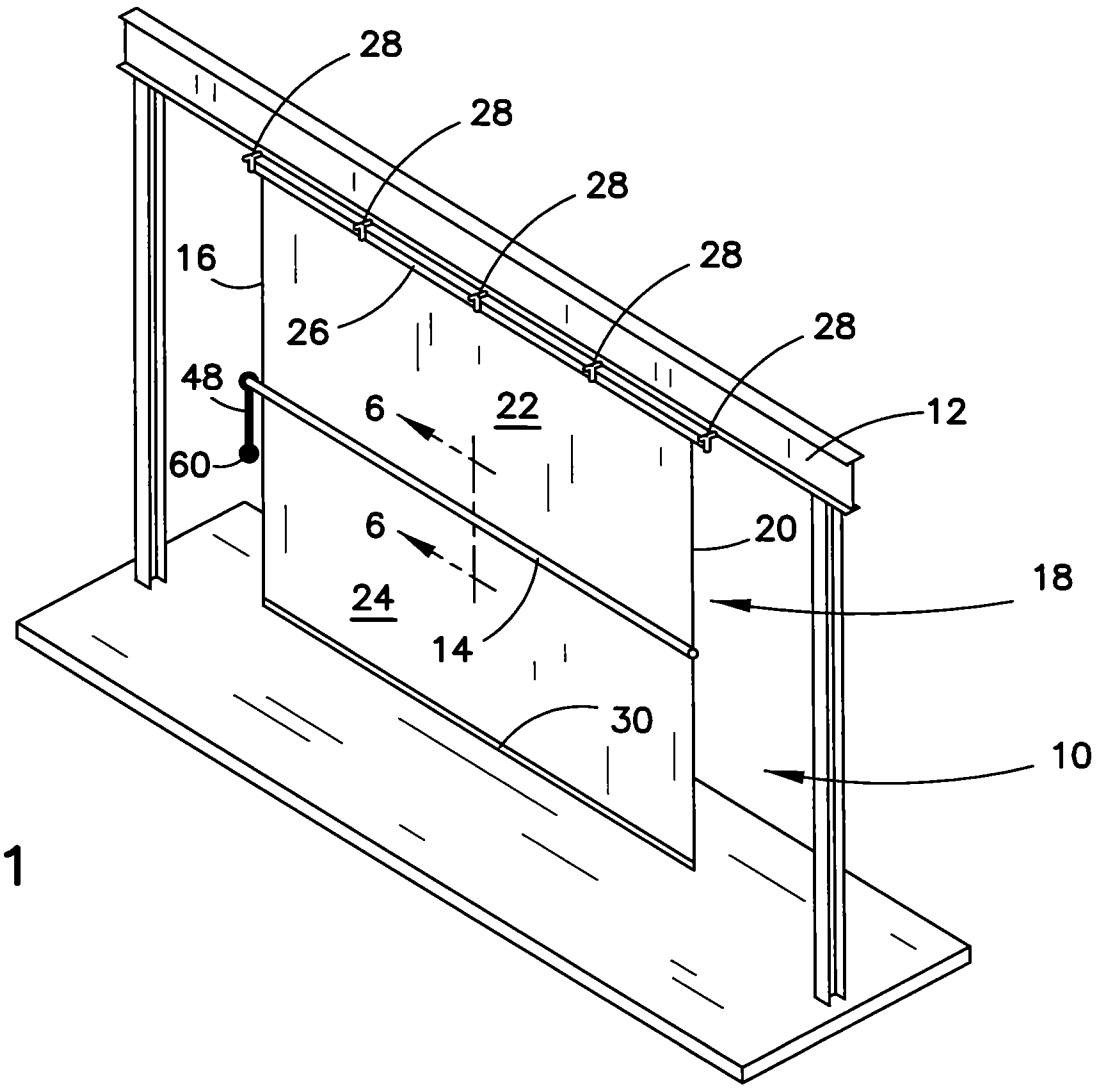
FIG. 1 is a perspective view of a flexible partition roller system.

FIG. 1 illustrates a flexible partition roller system 10 that is suspended from an overhead structure 12. The overhead structure 12 can be a specially erected structure or part of the ceiling or roofing structure of a building such as a gymnasium. The flexible partition roller system 10 is seen to include an elongated cylinder 14 extending from one side edge 16 of a flexible partition 18 to an opposite side edge 20. The cylinder 14 is connected to the partition 18 so as to divide the partition 18 into an upper portion 22 and a lower portion 24. An upper edge 26 of the upper portion 22 can be coupled to the overhead structure 12 by a plurality of clips or clamps 28. The cylinder 14 is connected to the partition 18 so that any rotation of the cylinder 14 from the position shown in FIG. 1 causes the cylinder 14 to roll upward on the upper portion 22. Such a rotation will also cause the lower portion 24 to roll up on the cylinder 14 so that the lower edge 30 of the lower portion 24 rises toward the overhead structure 12.

Figure 2:
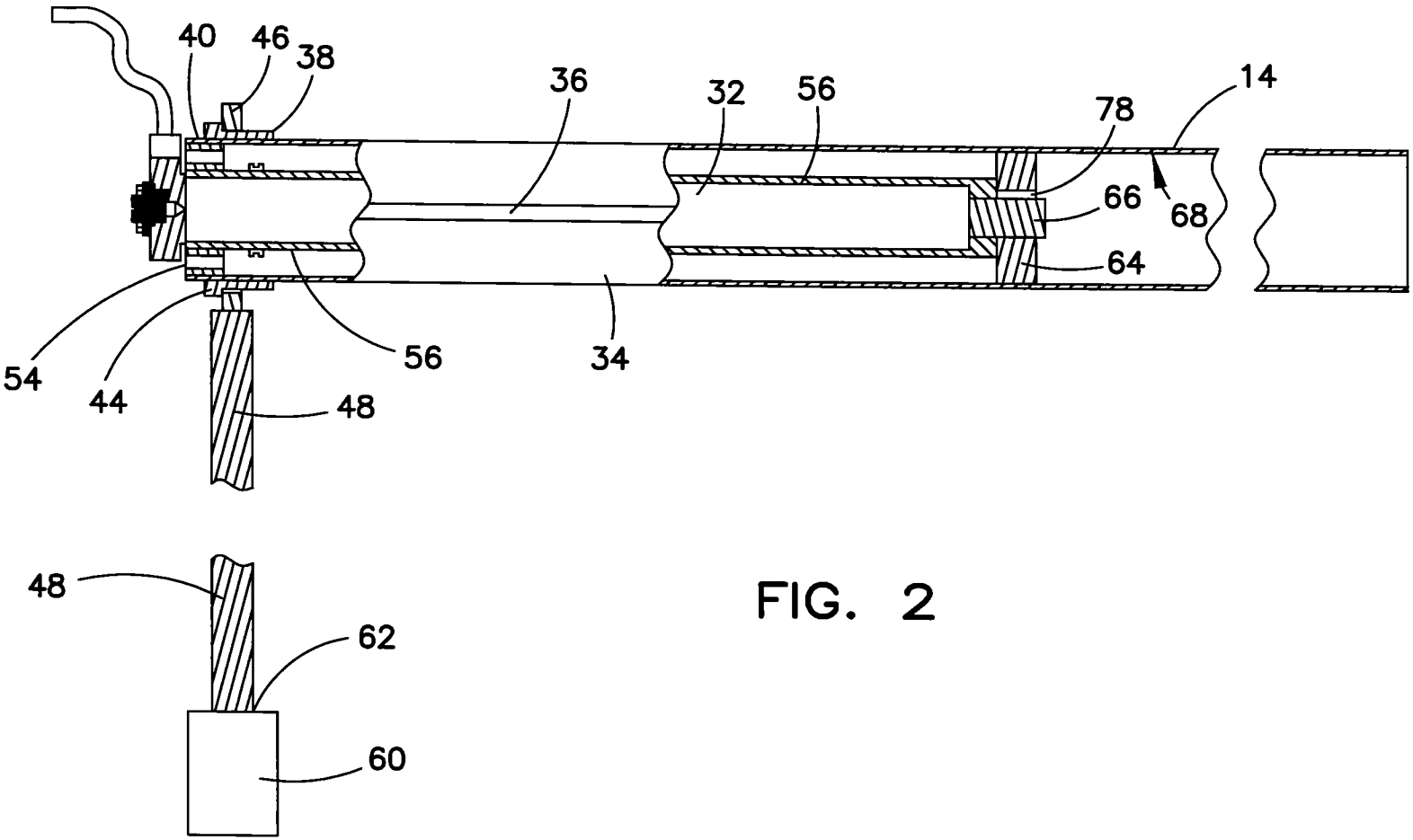
FIG. 2 is a sectional view of a roller that can be used in a flexible partition roller system.
Figure 6:
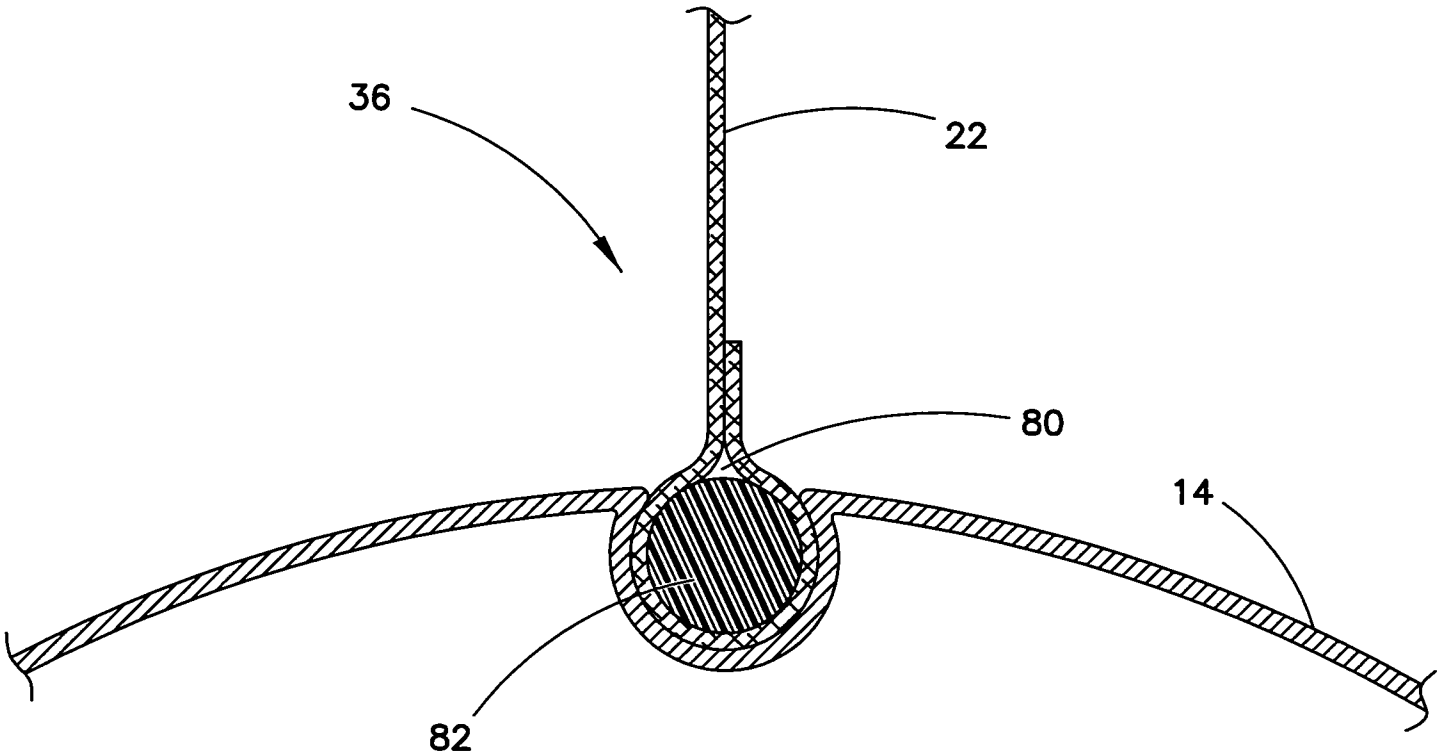
FIG. 6 is a sectional detail view taken along line 6-6 in FIG. 1 showing a junction between the elongated cylinder and the flexible partition.

The cylinder 14 is shown in greater detail in FIG. 2. The cylinder 14 can be of any length sufficient to span the width of the partition 18 and of any convenient diameter sufficient to receive a motor 32. The cylinder 14 can be formed of metal, such as aluminum or steel, or of extruded plastic. The outside surface 34 of cylinder 14 can include two linear grooves 36 running lengthwise of the cylinder 14. One groove 36 can receive a lower edge of the upper portion 22, while the other groove 36 can receive an upper edge of the lower portion 24. The edges of the upper and lower portions 22, 24 can be secured in the grooves 36 of cylinder 14 by any convenient means. For example, the edges of the upper and lower portions 22, 24 can include a small pocket 80 running the entire width of the portions 22, 24. With the pockets inserted into the grooves 36, a rod 82 having a length about equal to the width of the portions 22, 24, and a diameter only slightly smaller than the grooves 36 can be inserted into one end of the pocket so that the pocket and rod is retained in the groove 36 as shown in FIG. 6. Screws and other fasteners can also be used to retain the curtain portions to the grooves 36 of cylinder 14.

Figure 3:
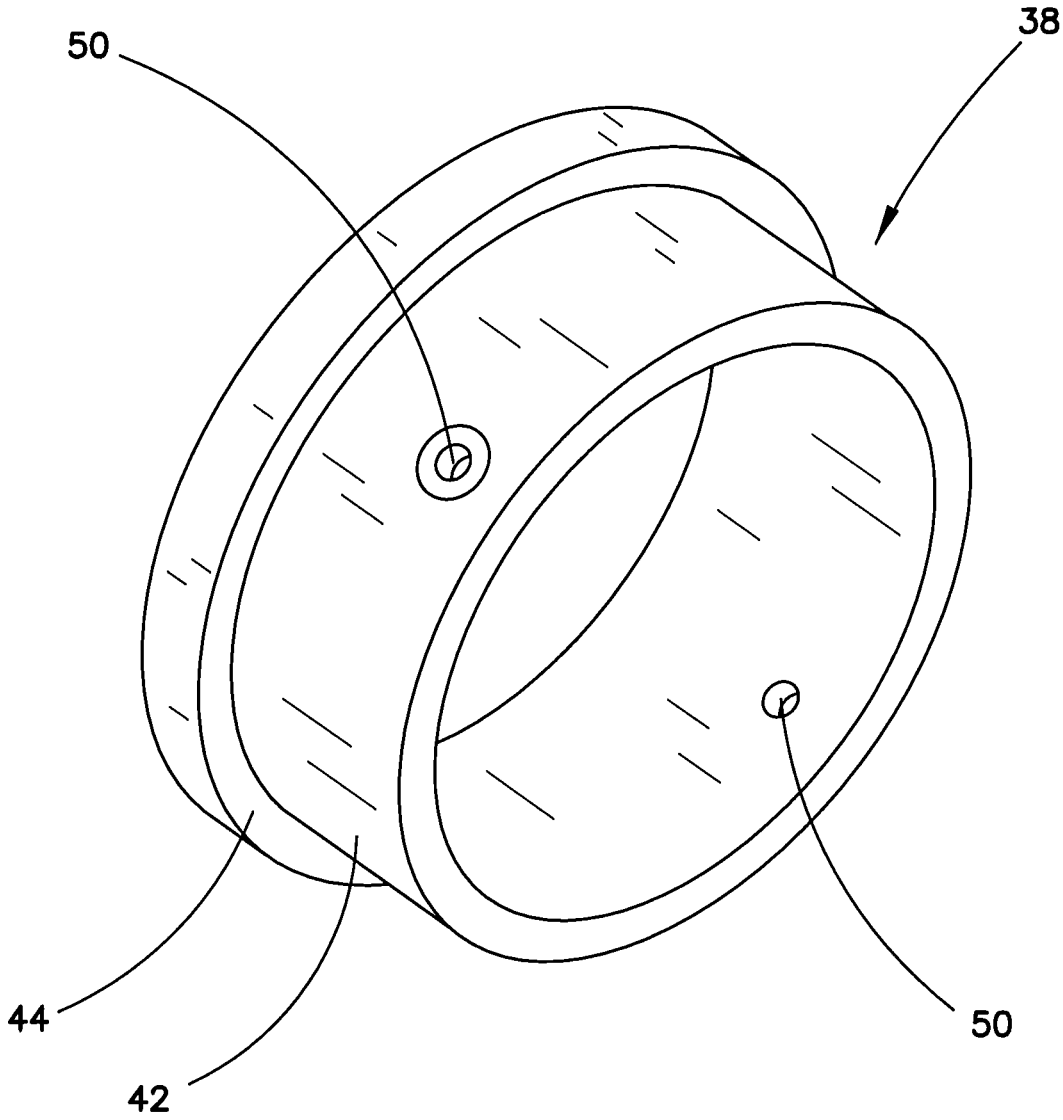
FIG. 3 is a perspective view of an outer bearing that can be used in a flexible partition roller system.

An outer bearing 38 can be fixed to the outside surface 34 of the cylinder 14 at a first end 40 of the elongated cylinder 14. The outer bearing 38 can have the form shown in FIG. 2 and FIG. 3 wherein an outside surface 42 of the outer bearing 38 includes a protruding edge 44 around the bearing 38. The protruding edge 44 is seen to extend radially outward from an outside surface 42 of the outer bearing 38. The outer bearing 38 can be secured to the elongated cylinder by screws or other fasteners extending through openings 50 of the bearing 38. The outer bearing 38 can be formed of a dry lubricant impregnated plastic such as Nylatron®. Alternatively, the outer bearing 38 can be a tapered or non-tapered roller bearing, a ball bearing or other similar bearing structure.

Figure 5:
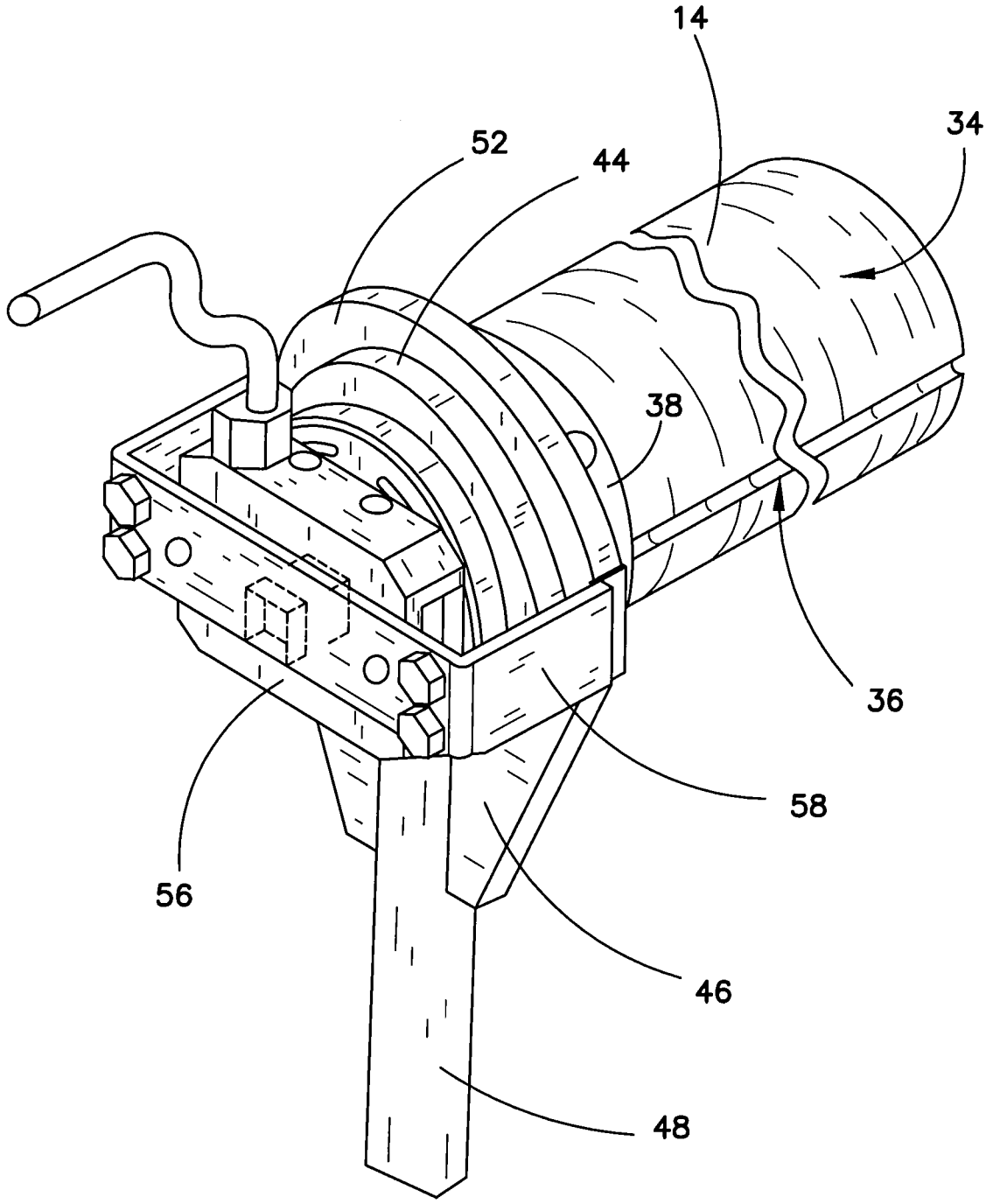
FIG. 5 is perspective view of one end of a roller that can be used in a flexible partition roller system.

A proximal end 46 of an arm 48 can be coupled to the outside surface 42 of the outer bearing 38 so that the outer bearing 38 permits rotation of the elongated cylinder 14 with respect to the arm 48. The proximal end 46 of the arm 48 can include a ring 52 surrounding the outer bearing 38 as shown in FIG. 5. The ring 52 can have an inner diameter less than the outer diameter of the outer bearing protruding edge 44 to provide a stop preventing axial movement of the proximal end 46 of the arm 48 relative to the elongated cylinder 14. At least one inner bearing 54 can be located between the motor 32 and the cylinder 14. The inner bearing 54 can be any bearing designed to permit rotation of the elongated cylinder 14 relative to one portion of the motor 32, such as the motor housing 56, which can include the stator portion of the motor 32.

A bracket 58 can be fixed to the motor housing 56 and to the arm proximal end 46 so that the bracket 58 extends over the protruding edge 44 of the outer bearing 38 to couple to the proximal end 46 of the arm 48. A counterweight 60 of sufficient mass can be fixed to a distal end 62 of the arm 48 to inhibit movement of the arm 48 and to inhibit rotation of the motor housing 56 during any rotation of the elongated cylinder 14.

Figure 4:
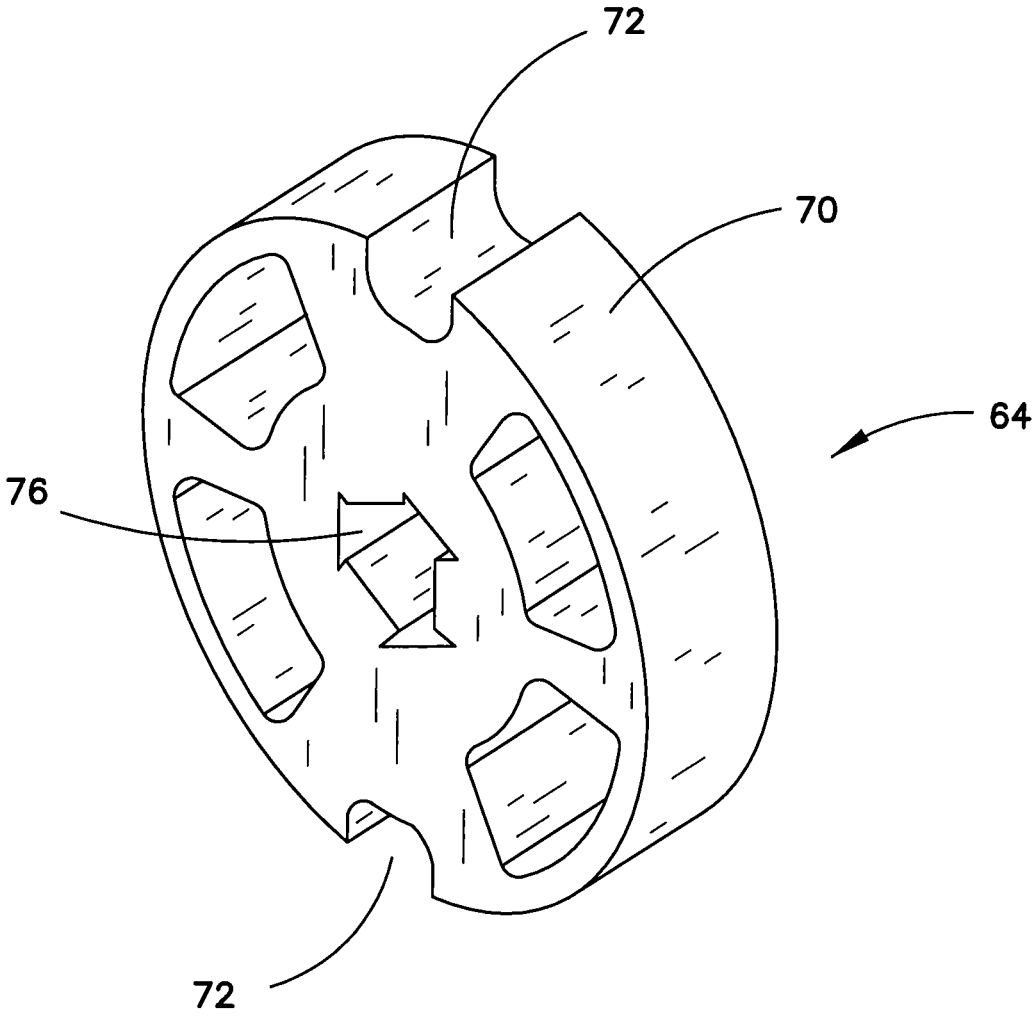
FIG. 4 is a perspective view of a drive adapter that can be used in a flexible partition roller system.

A drive adapter 64 can be coupled between a drive shaft 66 fixed to a rotor portion of the motor 32 and an inside surface 68 of the elongated cylinder 14. The drive adapter 64 can have an outside surface 70 that includes depressions 72 such as are shown in FIG. 4 to engage inward protrusions on the inside surface 68 of the elongated cylinder 14. The inward protrusions on the inside surface 68 of the elongated cylinder 14 can correspond to longitudinal grooves 36 on the outer surface 34 of the elongated cylinder 14. In particular, the depressions 72 in the outer surface 70 of the drive adapter 32 can be located diametrically opposite each other. The drive adapter 32 can also include at least one slot 76 adapted to engage a corresponding spline, key or similar feature 78 on the drive shaft 66 of the motor 32. The drive adapter 32 can be retained on the drive shaft 68 by a retaining ring, cotter pin, or other retaining element.

In a preferred embodiment the elongated cylinder 14 can have a mass $M_C$, for example, of about 26 lbs and an outside radius $R_C$, for example, of about 2 inches. The lower portion 24 of the partition 18 can have a mass $M_L$, for example, of about ?? lbs. The motor 32, such as a Elero model 11/8, can have a mass $M_M$, of about 12.5 lbs. The counterweight 60 can have any mass $M_W$, such as about 50 lbs., and can be fixed to the arm 48 at any selected distance $R_A$, for example about 1 foot, from the proximal end 46'. The counterweight mass $M_W$ and the length of the arm $R_A$ can be selected to provide a torque $M_W \times R_A > (M_L + M_C + M_M) \times R_C$, which is sufficient to inhibit rotation of the arm 48 during any rotation of the cylinder 14.

While these features have been disclosed in connection with the illustrated preferred embodiment, other embodiments of the invention will be apparent to those skilled in the art that come within the spirit of the invention as defined in the following claims.

The invention claimed is:

1. A flexible partition roller system for positioning a flexible partition at a desired vertical position relative to a ceiling comprising:

a flexible partition including a top edge having a coupling for suspending the partition from a ceiling, a bottom edge, and side edges, an elongated cylinder extending from one side edge of the partition to an opposite side edge, the cylinder being connected to the partition and dividing the partition into an upper and lower portion, an outer bearing fixed to an outside surface of a first end of the elongated cylinder, the outer bearing having an outside surface including a protrusion extending radially with respect to the elongated cylinder, an arm having a proximal end coupled to the outer bearing outer surface, the outer bearing permitting rotation of the elongated cylinder with respect to the arm, the outer bearing outer surface protrusion inhibiting any axial motion of the arm relative to the elongated cylinder, and a counterweight fixed to a distal end of the arm, to inhibit movement of the arm during any rotation of the elongated cylinder, a motor having a rotor portion and a stator portion, the rotor portion being coupled to the elongated cylinder for rotating the cylinder, and a bracket fixed to the stator portion of the motor and to the arm proximal end, the bracket extending over the protrusion of the outer bearing to couple the arm to inhibit rotation of the stator during any rotation of the elongated cylinder.

2. The flexible partition roller system of claim 1, further comprising at least one inner bearing located between the stator portion of the motor and the elongated cylinder permitting rotation of the elongated cylinder relative to the stator portion of the motor.

3. The flexible partition roller system of claim 1, wherein the proximal end of the arm includes a ring surrounding the outer bearing, the ring having an inner diameter less than the outer diameter of the outer bearing protrusion so that the protrusion provides a stop preventing axial movement of the proximal end of the arm relative to the elongated cylinder.

4. The flexible partition roller system of claim 3, further comprising a drive adapter coupled between the rotor portion of the motor and an inside surface of the elongated cylinder, the drive adapter having an outside surface including depressions engaging inward protrusions on the inner surface of the elongated cylinder corresponding to longitudinal grooves on the outer surface of the elongated cylinder.

5. The flexible partition roller system of claim 4, wherein the longitudinal grooves comprise a pair of longitudinal grooves extending into an outside surface of the cylinder, the grooves being located diametrically opposite each other, and wherein each of the upper and lower portions of the partition includes a terminal edge coupled into one of the longitudinal grooves.

6. A flexible partition roller system for positioning a flexible partition at a desired vertical position relative to a ceiling comprising:

a flexible partition including a top edge having a coupling for suspending the partition from a ceiling, a bottom edge, and side edges, an elongated cylinder of mass $M_C$ having a radius $R_C$ extending from one side edge of the partition to an opposite side edge, the cylinder being connected to the partition and dividing the partition into an upper and lower portion, the lower portion of the partition having a mass $M_L$;

a motor having mass $M_M$ coupled to the cylinder having a rotor portion and a stator portion, a first one of the rotor portion and stator portion being fixed to the cylinder for rotation with the cylinder, an arm having a proximal end fixed to a second one of the rotor portion and stator portion of the motor outside one side edge of the flexible partition, and a counterweight having a mass $M_W$ fixed to a distal end of the arm at a distance $R_A$ from the proximal end, the counterweight mass $M_W$ and the length of the arm $R_A$ being selected to provide a torque $M_W \times R_A > (M_L + M_C + M_M) \times R_C$ to inhibit rotation of the arm during any rotation of the cylinder.

7. The flexible partition roller system of claim 6, further comprising an outer bearing fixed to an outside surface of a first end of the elongated cylinder, the outer bearing having an outer surface coupled to the proximal end of the arm, the outer bearing permitting rotation of the cylinder with respect to the arm.

8. The flexible partition roller system of claim 7, further comprising a bracket coupling the arm to the second one of the rotor portion and stator portion of the motor outside one side edge of the flexible partition, the bracket extending over an outer edge of the outer bearing.

9. The flexible partition roller system of claim 8, wherein the outer bearing outer edge includes a protrusion extending radially with respect to the elongated cylinder, the protrusion providing a stop preventing axial movement of the proximal end of the arm relative to the elongated cylinder.

10. The flexible partition roller system of claim 6, further comprising at least one inner bearing located between the stator portion of the motor and the elongated cylinder permitting rotation of the elongated cylinder relative to the stator portion of the motor.

11. The flexible partition roller system of claim 10, further comprising an outer bearing fixed to an outside surface of a first end of the elongated cylinder located immediately outside one of the inner bearings, the outer bearing having an outer surface coupled to a proximal end of the arm, the outer bearing permitting rotation of the cylinder with respect to the arm.

12. The flexible partition roller system of claim 11, wherein an outer edge of the outer bearing includes a protrusion extending radially with respect to the elongated cylinder, the protrusion providing a stop preventing axial movement of the proximal end of the arm relative to the elongated cylinder.

13. The flexible partition roller system of claim 11, further comprising a bracket coupling the arm to the stator portion of the motor outside one side edge of the flexible partition, the bracket extending over the outer edge of the outer bearing.

14. The flexible partition roller system of claim 11, wherein the proximal end of the arm includes a ring surrounding the outer bearing, the ring having an inner diameter less than the outer diameter of the outer bearing protrusion.

15. The flexible partition roller system of claim 10, further comprising a drive adapter coupled between the rotor portion of the motor and an inside surface of the elongated cylinder.

16. The flexible partition roller system of claim 14, wherein the elongated cylinder includes a pair of longitudinal grooves extending into an outside surface of the cylinder, the grooves being located diametrically opposite each other, wherein each of the upper and lower portions of the partition includes a terminal edge coupled into one of the longitudinal grooves, and wherein the drive adapter has an outside surface including depressions engaging inward protrusions on the inner surface of the elongated cylinder corresponding to the grooves.

17. The flexible partition roller system of claim 16, wherein the terminal edges of the partition include a pocket extending the entire width of the partition, and a rod is situated in each pocket having a diameter similar to the groove diameter to retain the terminal edges in position in the longitudinal grooves of the cylinder.

* * * * *